US005916726A

United States Patent [19]

Kanda et al.

[11] Patent Number: 5,916,726

[45] Date of Patent: Jun. 29, 1999

[54] PROCESS FOR PRODUCING TONER FOR DEVELOPING ELECTROSTATIC IMAGES

[75] Inventors: Hitoshi Kanda, Yokohama; Kuniaki Kamiichi, Toride, both of Japan

[73] Assignee: Canon Kabushiki Kaisha, Tokyo, Japan

[21] Appl. No.: 09/020,235

[22] Filed: Feb. 6, 1998

[30] Foreign Application Priority Data

Feb. 10, 1997 [JP] Japan ..... 9-026353

[51] Int. Cl.[6] ..... G03G 9/09

[52] U.S. Cl. ..... 430/137; 430/138

[56] References Cited

U.S. PATENT DOCUMENTS

| | | | |
|---|---|---|---|
| 2,297,691 | 10/1942 | Carlson | 95/5 |
| 4,076,640 | 2/1978 | Forgensi et al. . | |
| 4,985,524 | 1/1991 | Amano et al. | 526/344.2 |
| 5,334,473 | 8/1994 | Kobayashi et al. | 430/109 |
| 5,418,104 | 5/1995 | Lawson | 430/137 |

FOREIGN PATENT DOCUMENTS

| | | |
|---|---|---|
| 0531932 | 3/1993 | European Pat. Off. . |
| 0606930 | 7/1994 | European Pat. Off. . |
| 36-10231 | 7/1961 | Japan . |
| 43-10799 | 5/1968 | Japan . |
| 51-14895 | 5/1976 | Japan . |

OTHER PUBLICATIONS

Pat Abst., Japan, vol. 12, No. 180 (P–709) May 1988, JP 62–289856.

Pat Abst., Japan, vol. 14, No. 048 (P–0997) Jan. 1990, JP 01–277254.

Pat Abst., Japan, vol. 096, No. 010, Oct. 1996, JP 08–146667.

Brandrup et al., "Polymer Handbook", 2nd Ed. publ. J. Wiley & Sons pp. (III–139)–(III–192).

*Primary Examiner*—John Goodrow

*Attorney, Agent, or Firm*—Fitzpatrick, Cella, Harper & Scinto

[57] ABSTRACT

A process for producing a toner for developing electrostatic images is disclosed. A polymerizable monomer composition is first prepared and dispersed in an aqueous medium by the action of high shear force to produce particles. The polymerizable monomer is then polymerized in a container having a jacket. The liquid temperature inside the container is controlled by feeding a high-pressure vapor into the jacket while adjusting the degree of vacuum inside the jacket. The production process can achieve a superior temperature response, can keep the reaction system at a constant temperature with ease and can realize shortened production time and reduced production cost.

33 Claims, 2 Drawing Sheets

PROCESS FOR PRODUCING TONER FOR DEVELOPING ELECTROSTATIC IMAGES

BACKGROUND OF THE INVENTION

1.Field of the Invention

This invention relates to a process for producing a toner for developing electrostatic images.

2.Related Background Art

A number of methods as disclosed in U.S. Pat. No. 2,297,691, etc. are known as electrophotography. In general, using a photosensitive member comprising a photoconductive material, copies or prints are obtained by forming an electrostatic image on the photosensitive member, subsequently developing the electrostatic image by the use of a toner to form a toner image, transferring the toner image to a transfer medium such as paper if necessary, and thereafter fixing the toner image onto the transfer medium by the action of heat, pressure or heat-and-pressure. As methods for developing the electrostatic image by the use of toners or methods for fixing the toner image, a variety of methods have been proposed.

Toners used for such purpose have been commonly produced by melt-kneading colorants comprising dyes and/or pigments, into thermoplastic resins to effect uniform dispersion, followed by pulverization using a finely grinding mill, and the pulverized product is classified using a classifier to produce toners having desired particle diameters.

Fairly good toners can be produced by such a production method, but there is a limit to the range in which toner materials are selected. For example, colorant-dispersed resin compositions must be brittle enough to be pulverizable with ease by means of a fine grinding mill. However, such resin compositions made brittle in order to meet these requirements tend to result in a broad particle size distribution of the particles formed when actually pulverized at a high speed, especially causing a problem that fine particles tend to be produced in a relatively large proportion. Moreover, toners obtained from such highly brittle materials tend to be further pulverized in developing assemblies of copying machines or printers. Also, in the melt-kneading method, it is difficult to uniformly disperse solid fine particles of colorants or the like in the resin, and some toners may cause an increase in fog, a decrease in image density and a lowering of color mixing properties or transparency of toners at the time of image formation, depending on the degree of dispersion. Accordingly, care must be well taken when colorants are dispersed. Also, colorants may come bare to rupture sections of pulverized particles, and may cause fluctuations in developing performance of toners.

In order to overcome the problems of the toners produced by such melt-kneading and pulverization, toners produced by suspension polymerization are proposed as disclosed in Japanese Patent Publications No. 36-10231, No. 43-10799 and No. 51-14895, and also various polymerization methods and production processes for such toners are proposed. For example, in the process for producing toners by suspension polymerization, a polymerizable monomer, a colorant and a polymerization initiator, and also optionally a cross-linking agent, a charge control agent and other additives are uniformly dissolved or dispersed to form a polymerizable monomer composition. Thereafter, this polymerizable monomer composition is dispersed in an aqueous medium containing a dispersion stabilizer, by means of a suitable agitator, and is simultaneously subjected to polymerization reaction to obtain toner particles having the desired particle diameters.

Since this method has no step of pulverization, the toner particles are not required to be brittle, and hence soft materials can be used as the resin. Also, colorants may hardly come bare to the surfaces of toner particles, and hence the toner particles can have a uniform triboelectric charging performance. This method has such advantages. Also, since the toners obtained have a relatively sharp particle size distribution, the step of classification can be omitted, or, even when classified, toners can be obtained in a high yield. The method also has the advantage that, since a low-softening substance can be encapsulated in toner particles in a large quantity, the toners obtained have superior anti-offset properties.

When the polymerization toners are produced, it is essential to control temperatures of the reaction system in the mixing step of preparing a polymerizable monomer composition containing at least a polymerizable monomer and a colorant, in the granulation step of dispersing the polymerizable monomer composition in an aqueous medium by the action of a high shear force to bring it into particles and in the polymerization step of polymerizing the particles of the polymerizable monomer composition. Hitherto, as methods of heating the contents and keeping the temperature constant, it is common to use a method in which hot water is used as a heat source. Such hot-water heating, however, has problems such that it results in a poor productivity, requires a great cost to heat water, and makes it necessary to make great maintenance because of corrosion and accumulation of scale in a jacket. Also, in a method in which a jacket is filled with water vapor having a pressure of atmospheric pressure or higher, i.e., 100° C. or higher saturated water vapor, the method can achieve a good temperature response, but the difference in temperature between the jacket and the materials to be treated is so great that the liquid temperature may vary in a great range to make it difficult to keep a constant temperature, tending to cause a lowering of product quality.

In addition, since deposits such as scale tend to be formed on the inner walls of the container used in the polymerization step, glass lining and fluorine resin are preferably used as inner wall materials for the container. Such materials have a poorer heat conduction than usual metallic materials, and hence a poor temperature response comes into question especially when the temperature control method employing hot water as a heat source is used.

SUMMARY OF THE INVENTION

An object of the present invention is to provide, as a process for producing by polymerization a toner for developing electrostatic latent images, a production process that can achieve a superior temperature response and can keep the reaction system at a constant temperature with ease.

Another object of the present invention is to provide a production process that can make the production time shorter than conventional processes.

Still another object of the present invention is to provide a production process that can make the production cost lower than conventional processes.

A further object of the present invention is to provide a process for producing a toner having a superior fixing performance.

According to the present invention, there is provided a process for producing a toner for developing electrostatic latent images; the toner comprising toner particles, and the process comprising;

a mixing step of preparing a polymerizable monomer composition containing at least a polymerizable monomer and a colorant;

a granulation step of dispersing the polymerizable monomer composition in an aqueous medium by the action of a high shear force to produce particles of the polymerizable monomer composition; and a polymerization step of polymerizing the polymerizable monomer held in the particles of the polymerizable monomer composition, to form the toner particles;

wherein the polymerization step is carried out in a container having a jacket, and the liquid temperature inside the container is controlled by feeding a high-pressure vapor into the jacket while adjusting the degree of vacuum inside the jacket.

DESCRIPTION OF THE PREFERRED EMBODIMENTS

Figure 1:
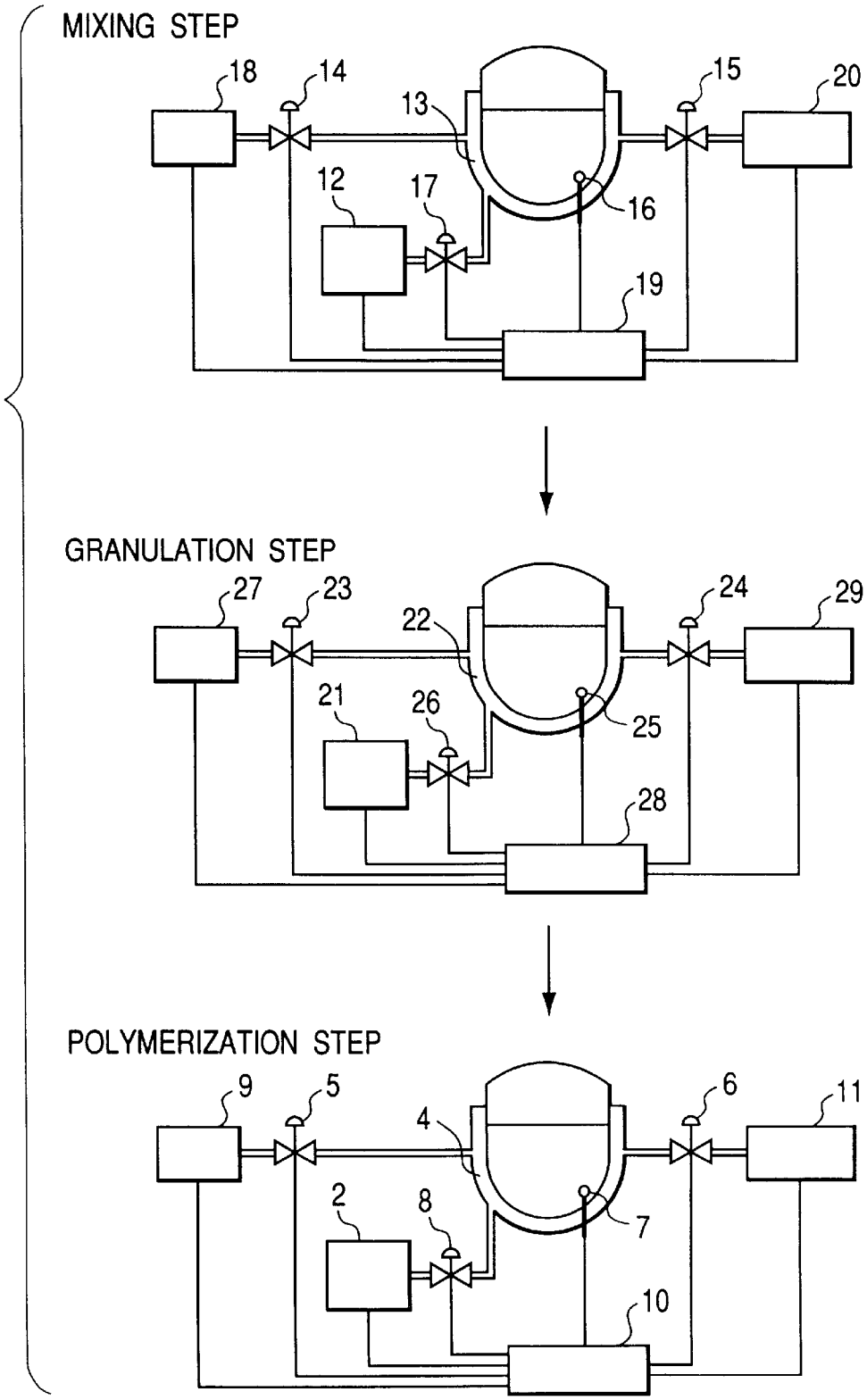
FIG. 1 shows a flow chart of the toner production process of the present invention.

The toner production process of the present invention has at least a mixing step, a granulation step and a polymerization step. In the mixing step, a polymerizable monomer, a colorant, a release agent and a polymerization initiator, and further optionally a cross-linking agent, a charge control agent and other additives, are uniformly mixed or dispersed to prepare a polymerizable monomer composition. In the granulation step, the polymerizable monomer composition thus prepared is dispersed in an aqueous medium containing a dispersion stabilizer, by an agitation means having a high shear force, to form particles of the polymerizable monomer composition, having the desired particle diameters. In the polymerization step, the polymerizable monomer contained in the particles of the polymerizable monomer composition are polymerized to form toner particles. After the reaction is completed, the toner particles formed are collected through washing and filtration, followed by drying.

In the polymerization step, the polymerization is carried out setting the polymerization temperature of the reaction system to a temperature of 40° C. or above, and usually from 50 to 90° C. In the mixing step and granulation step, too, it is very important to control the temperature of contents.

As a result of extensive studies, the present inventors have discovered that, for the purpose of controlling the reaction system, it is very preferable to use, as a heat source, water vapor having a lower absolute pressure than the atmospheric pressure.

The container used in the process for production of a polymerization toner is required to have a good temperature response, and also its inner wall is required to be formed of a material to which the contents hardly deposit.

As a heat source achievable of such a good temperature response, vapor of a high pressure not lower than the atmospheric pressure is commonly used, and such high-pressure vapor may preferably be saturated water vapor of 100° C. or above, where the liquid temperature inside the container can be raised in a very short time and in a good efficiency. However, in the process for producing the toner by suspension polymerization, the polymerization is carried out usually at a temperature of from 45 to 95° C., preferably 50 to 90° C. as previously stated, and hence the difference in temperature between the contents and the jacket is so great that the liquid temperature may fluctuate in a great range and can be controlled with difficulty when the reaction system should be controlled at a constant temperature. The heat source is fed into the jacket. When the inside of the jacket is filled with the high-pressure vapor, there is a problem that the reaction product may greatly deposit on the inner wall surface of the container because the temperature in the jacket exceeds 100° C. As a method of low-temperature heating, hot-water heating is widely used. When the hot-water heating is used, the problems on the precision of control for keeping a constant temperature and on the deposits inside the container are solved to a certain extent. However, since the hot-water heating utilizes sensible heat, the temperature of the hot water tends to drop and the quantity of heat may decrease to cause a decrease in the rate of temperature rise, resulting in a lowering of productivity. It has such a problem. Also, since the hot water requires a great energy for controlling the temperature, the cost for producing toners increases.

On the other hand, the toner production process of the present invention can solve such problems.

The present invention is achieved by using as a heat source the water vapor having a lower absolute pressure than the atmospheric pressure. In the case of saturated vapor, it is characteristic of "latent heat quantity" which is greater as the absolute pressure is lower. Accordingly, filling the inside of the jacket with the water vapor having a low absolute pressure than the atmospheric pressure leads to effective utilization of energy, resulting in a very good efficiency. Also, since only "latent heat" that accompanies a change in state of water vapor is principally used as the heat source, the temperature drop little occurs, promising a good thermal efficiency. In addition, bringing the temperature of water vapor into proximity to the control temperature of the contents makes it possible to keep the temperature of the contents more constant, increasing the stability of the product quality. The water vapor inside the jacket used, i.e., the degree of vacuum in the jacket may preferably be controlled to have an absolute pressure of from 10 kPa to 90 kPa, and more preferably from 10 kPa to 80 kPa. Hence, the temperature inside the jacket may preferably be controlled to 45 to 95° C., more preferably 50 to 90° C.

The high-pressure vapor fed into the jacket may preferably be a saturated water vapor, and the water vapor inside the jacket may also preferably be a saturated water vapor. For the saturated water vapor, the temperature of water vapor is known by the vapor pressure, and it is preferable to use the saturated water vapor when the temperature is controlled.

The container as a polymerization vessel used in the step of polymerization has a jacket structure. The inside of the jacket is evacuated and the high-pressure vapor is fed into it to form the water vapor having a lower absolute pressure than the atmospheric pressure. Using this water vapor as a heat source, the solution is indirectly heated. If the heat source is directly fed into the polymerization vessel, it follows that high-temperature heat is directly transmitted to the contents, to tend to result in non-uniform polymerization reaction.

A mixing vessel and a granulation vessel used in the mixing step and the granulation step, respectively, may preferably also have jacket structures. It is also preferable that the inside of each jacket is evacuated, the high-pressure vapor is fed into it to form the water vapor having a lower absolute pressure than the atmospheric pressure, and, using this water vapor as a heat source, the solution is indirectly heated.

As another problem in the process for producing the toner by suspension polymerization, the polymerizable monomer composition may deposit on the inside of the container. This comes into a great question of scale especially in the polymerization vessel. If the scale of a polymeric product has stiffly adhered to the inner walls of the polymerization vessel and has adhered at a great degree, the temperature control may be affected. If the deposits such as scale have come off, they come to be impurities in the product to cause a problem on the product quality. Especially when the temperature is controlled using the high-pressure vapor, the deposits tend to be formed on the inner wall of the container because of a high temperature at the jacket. Accordingly, as a countermeasure for such deposits, glass lining and fluorine resin coating or lining are commonly in wide use to make up the inner walls. In such an instance, the problem of deposits inside the container can be solved. However, because of a lower heat conduction from the tank jacket than iron type materials, another problem of a low rate of temperature rise or temperature drop tends to occur when the temperature is raised or dropped. Such a problem may remarkably occur especially when heated with hot water.

However, in the process of the present invention the use of the water vapor having a lower absolute pressure than the atmospheric pressure ensures a better thermal efficiency than the use of hot water, and hence can solve such a problem, too. That is, it is possible to accomplish a process for producing a toner by suspension polymerization, that may less cause the deposits inside the polymerization vessel, can achieve a superior temperature response and can keep the reaction system at a constant temperature with ease.

Usually, the temperature of each container is controlled by detecting the temperature of the materials in the container by means of a temperature sensor to control the vapor pressure of water vapor inside the jacket in accordance with the information thus detected.

There are no particular limitations on the apparatus used in the mixing step of the process of the present invention. Usually, a mixer comprising a vertical cylindrical (jacket type) container provided with an agitator is used. The agitator may be of any type so long as the materials in the container can be uniformly stirred. Usually, a paddle blade, an anchor blade, a screw blade or the like is preferably used, which may be appropriately selected according to physical properties of the contents. The container may be a container made of iron or a container whose inner walls are provided with glass lining or coated with fluorine resin, any of which may be used.

In the mixing step, at least a release agent, a colorant and a polymerization initiator, and further optionally a cross-linking agent, a charge control agent and other additives, are uniformly mixed or dispersed in the polymerizable monomer.

In the granulation step of the process of the present invention, an apparatus provided with an agitator having a high shear force may preferably be used. As the agitator having a high shear force, T. K. Homomixer (manufactured by Tokushu Kika Kogyo K.K.), Clearmix (manufactured by M.Technique K.K.) or the like may preferably be used. Any of these apparatus comprises a rotating blade (rotor) rotatable at a high speed and a stationary blade (stator), and the contents are made into particles by the action of a strong shear force produced at very small gaps between them. The container used in the granulation step may be a container made of iron or a container whose inner walls are provided with glass lining or coated with fluorine resin, any of which may be used.

Usually, when the granulation is carried out using such an apparatus, the polymerizable monomer composition is put into a granulation vessel in which a liquid dispersion medium non-compatible with the monomer composition has been charged, followed by dispersion to carry out granulation. The particle diameter of the particles to be obtained is controlled usually by adjusting the quantity of the dispersion stabilizer used and the number of revolution of the agitating blade.

Subsequently, in the polymerization step of the process of the present invention, the particles formed in the granulation step are polymerized and hardened. In some cases, the conditions for agitation of the apparatus used in the granulation step may be changed so that the granulation apparatus may serve also as a polymerization apparatus. It, however, is common to move the contents from the granulation apparatus to the polymerization apparatus, and to complete the polymerization reaction in the polymerization container to obtain solid particles. There are no particular limitations on the apparatus used in this polymerization step. Usually, an apparatus comprising a vertical cylindrical (jacket type) container provided with an agitator is used. The agitator may be of any type so long as the materials in the container can be uniformly stirred. Usually, a paddle blade, an anchor blade, a screw blade or the like is preferably used, which may be appropriately selected according to physical properties of the contents. In this instance, an appropriate condition of agitation is required such that any excess shear force that may cause a break of particles formed is not applied and also the particles do not coalesce one another. This is controlled by, e.g., adjusting the shape of the agitating blade and the number of revolution of the agitating blade. The container used in the polymerization step may be a container made of iron or a container whose inner walls are provided with glass lining or coated with fluorine resin, any of which may be used. In particular, a container whose inner wall is provided with glass lining is preferred in view of the prevention of deposits inside the container.

After the polymerization is completed, a vacuum distillation step may optionally follow in order to remove residual monomers. In view of efficiency, this may preferably be carried out using the polymerization vessel also as a container therefor.

A flow chart of the toner production process of the present invention is shown in FIG. 1.

In the mixing step, reference numeral 12 denotes a vacuum generator; 13, a tank jacket; 14, 15 and 17, control valves; 16, a temperature detector; 18, a high-pressure vapor feeder; 19, a computer; and 20, a cooling means.

In the granulation step, reference numeral 21 denotes a vacuum generator; 22, a tank jacket; 23, 24 and 26, control valves; 25, a temperature detector; 27, a high-pressure vapor feeder; 28, a computer; and 29, a cooling means.

In the polymerization step, reference numeral 2 denotes a vacuum generator; 4, a tank jacket; 5, 6 and 8, control valves; 7, a temperature detector; 9, a high-pressure vapor feeder; 10, a computer; and 11, a cooling means.

Figure 2:
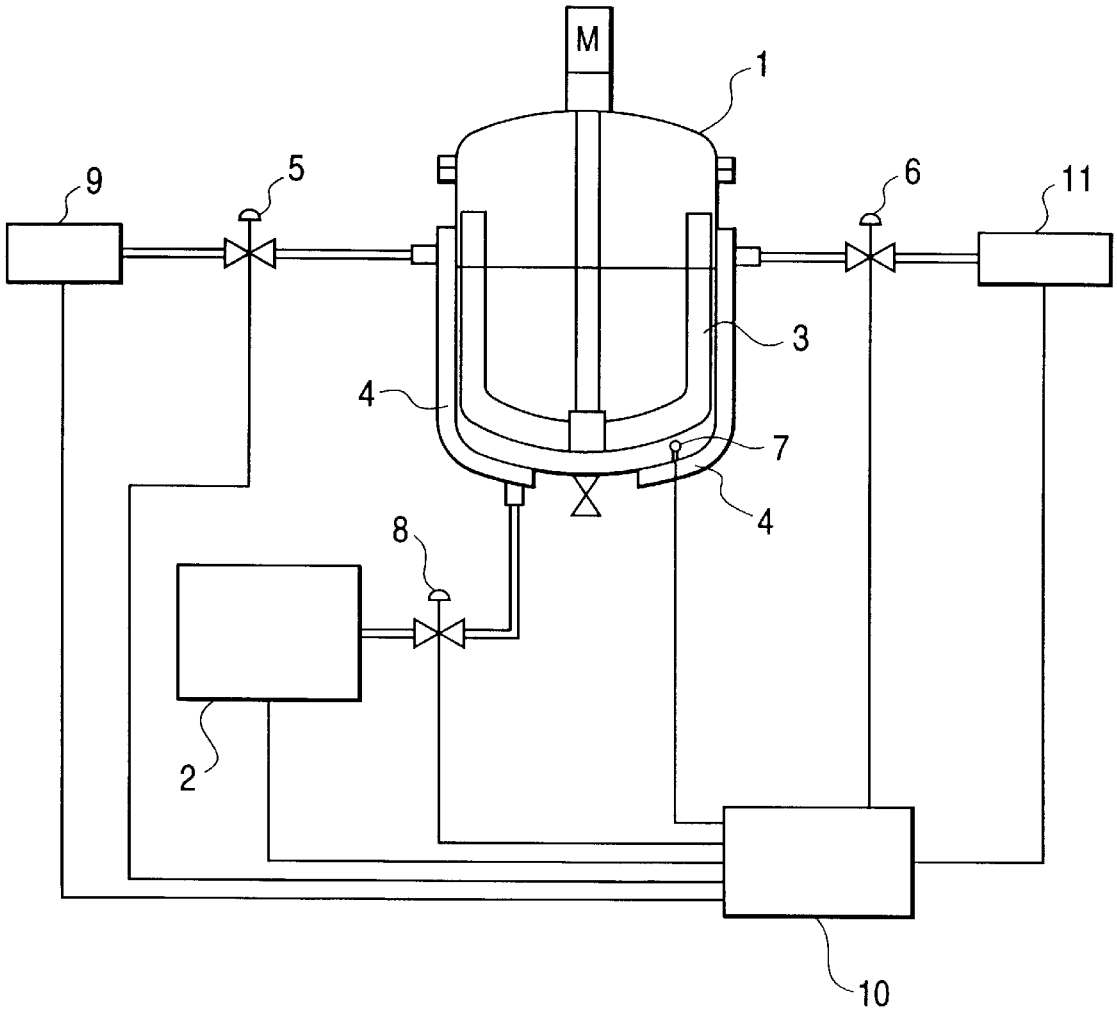
FIG. 2 schematically illustrates an example of an apparatus used in the step of polymerization.

FIG. 2 schematically illustrates an example of the apparatus used in the polymerization step.

In FIG. 2, reference numeral 1 denotes a polymerization vessel; 2, a vacuum generator; 3, an agitator; 4, a tank jacket; 5, 6 and 8, control valves; 7, a temperature detector; 9, a high-pressure vapor feeder; 10, a computer; and 11, a cooling means.

In the present apparatus, the inside of the tank jacket has been evacuated by means of the vacuum generator 2, and high-pressure vapor is fed into it through the control valve 5. The degree of vacuum in the jacket is controlled to control the absolute pressure of water vapor in the jacket, whereby the liquid temperature in the polymerization vessel can be controlled to the stated temperature in a good efficiency.

When cooled, cooling water is fed through the control valve 6 to carry out vacuum vaporization cooling. In respect of the cooling, too, vaporization cooling in vacuum is prefer red to t he cooling made by cooling water only, because of a better efficiency and a smaller quantity of cooling water used.

After the polymerization step is completed, a dispersant removing step, a solid-liquid separation step and a drying step follow to obtain the toner particles.

The toner production process of the present invention is preferably used when a toner having both good fixing performance and good anti-blocking properties is produced, which is so produced that the toner has what is called a core/shell structure comprised of cores covered with shell resin, the shell being formed by polymerization.

As a main component of the core, it is preferable to use a low-softening substance. It is preferable to use a compound having an endothermic maximum peak of DSC (differential scanning calorimetry) within a temperature range of from 40 to 90° C. as measured according to ASTM D3418-8. If the maximum peak is lower than 40° C., the low-softening substance may have a weak self-cohesive force, undesirably resulting in weak high-temperature anti-offset properties. If on the other hand the maximum peak is higher than 90° C., fixing temperature may become higher undesirably. Moreover, if the endothermic peak value is at a high temperature, the low-softening substance may undesirably precipitate during granulation in the aqueous medium to hinder the reaction of suspension polymerization.

The temperature of the DSC maximum peak value is measured using, e.g., DSC-7, manufactured by Perkin Elmer Co. The temperature at the detecting portion of the device is corrected on the basis of melting points of indium and zinc, and the calorie is corrected on the basis of heat of fusion of indium. The sample is put in a pan made of aluminum and an empty pan is set as a control, to make measurement at a rate of temperature rise of 10° C./min.

The low-softening substance may specifically include paraffin waxes, polyolefin waxes, Fischer-Tropsch waxes, amide waxes, higher fatty acids, ester waxes, and derivatives of these or grafted or blocked compounds of these.

The low-softening substance may preferably be added in the toner particles in an amount of from 5 to 30% by weight. Its addition in an amount less than 5% by weight may make the toner have poor low-temperature fixing performance. On the other hand, its addition in an amount more than 30% by weight tends to cause toner particles to coalesce one another during granulation also when the toner particles are produced by polymerization, tending to produce toner particles having a broad particle size distribution.

As a specific method by which the low-softening substance is encapsulated, a low-softening substance whose polarity in an aqueous medium is smaller than the main polymerizable monomer may be used and also a small amount of resin or polymerizable monomer with a greater polarity than the main monomer may be added. Thus, toner particles having the core/shell structure can be obtained. The particle size distribution and particle diameter of the toner particles may be controlled by a method in which the types and amounts of a water-insoluble inorganic salt and a dispersant having the action of protective colloids are changed, or by changing the conditions of mechanical apparatus, for example, the conditions for agitation (e.g., the peripheral speed of a rotor, pass times, and the shape of agitating blades), the shape of the reaction vessel, or the concentration of solid matter in the aqueous medium, whereby the desired toner particles can be obtained.

Cross sections of the toner particles can be observed by, e.g., a method in which toner particles are well dispersed in a room temperature curing resin, followed by curing in an atmosphere of temperature 40° C. for 2 days, and the cured product obtained is dyed with triruthenium tetraoxide optionally in combination with triosmium tetraoxide, thereafter samples are cut out in slices by means of a microtome having a diamond cutter to observe the cross sections of toner particles using a transmission electron microscope (TEM). In the present invention, it is preferable to use the triruthenium tetraoxide dyeing method in order to form a contrast between the materials by utilizing some difference in crystallinity between the low-softening substance used and the resin constituting the shell.

As the polymerizable monomer used in the present invention, it is preferable to use styrene monomers such as styrene, o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and ene monomers such as butadiene, isoprene, cyclohexene, acrylonitrile or methacrylonitrile and acrylic or methacrylic amide. Any of these may be used alone, or usually used in the form of an appropriate mixture of monomers so mixed that the theoretical glass transition temperature (Tg) as described in a publication POLYMER HANDBOOK, 2nd Edition III, pp.139–192 (John Wiley & Sons, Inc.) ranges from 40 to 80° C. If the theoretical glass transition temperature is lower than 40° C., problems may arise in respect of storage stability of the toner or running stability of the developer. If on the other hand it is higher than 80° C., the fixing point of the toner may become higher. Especially in the case of color toners used to form full-color images, the color mixing performance of the respective color toners at the time of fixing may be unsatisfactory, resulting in a poor color reproducibility, and also OHP images may have a very poor transparency. Thus, such temperatures are not preferable in view of high image quality.

When the toner particles having such core/shell structure are produced, in order to encapsulate the low-softening substance with the shell resin, it is particularly preferable to further add a polar resin as an additional shell resin. As the polar resin used in the present invention, copolymers of styrene with acrylic or methacrylic acid, maleic acid copolymers, saturated polyester resins and epoxy resins are preferably used. The polar resin may particularly preferably be those not containing in the molecule any unsaturated groups that may react with the shell resin and the polymerizable monomer. If a polar resin having such unsaturated groups is used, cross-linking reaction with the polymerizable monomer that forms the shell resin layer takes place, so that the shell resin comes to have a too high molecular weight for the toners for forming full-color images and is disadvantageous for color mixture of multiple color toners. Thus, such a resin is not preferable.

The polar resin used in the present invention may preferably have number average molecular weight (Mn) in the range of from 1,000 to 500,000.

For the colorant used in the present invention, carbon black, magnetic materials, and colorants toned in black by the use of yellow, magenta and cyan colorants shown below may be used as black colorants.

As a yellow colorant, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147, 168, etc., are preferably used.

As a magenta colorant, condensation azo compounds, diketopyrrolopyrrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 and 254 are particularly preferable.

As a cyan colorant, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62, 66, etc. may be particularly preferably used.

Any of these colorants may be used alone, in the form of a mixture, or in the state of a solid solution. In the case of color toners, the colorants are selected taking account of hue angle, chroma, brightness, environmental stability, transparency on OHP films and dispersibility in toner particles. The colorant may preferably be used in an an amount of from 1 to 20 parts by weight based on 100 parts by weight of the binder resin. In the case when a magnetic material is used as the black colorant, it may preferably be used in an amount of from 40 to 150 parts by weight based on 100 parts by weight of the binder resin, which is different from the amount of other colorant.

As the charge control agent used in the present invention, known agents may be used. In the case of color toners, it is preferable to use charge control agents that are colorless, make toner charging speed higher and are capable of stably maintaining a constant charge quantity. Also, charge control agents having no polymerization inhibitory action and being insoluble in the aqueous system are particularly preferred. As specific compounds, they may include, as negative charge control agents, metal compounds of salicylic acid, naphthoic acid or dicarboxylic acids, polymer type compounds having sulfonic acid or carboxylic acid in the side chain, boron compounds, urea compounds, silicon compounds and carixarene. As positive charge control agents, they may include quaternary ammonium salts, polymer type compounds having such a quaternary ammonium salt in the side chain, guanidine compounds, and imidazole compounds. Any of these charge control agents may preferably be used in a amount of from 0.5 to 10 parts by weight based on 100 parts by weight of the binder resin. In the present invention, however, the addition of the charge control agent is not essential. In the case when two-component development is employed, the triboelectric charging with a carrier may be utilized, and also in the case when non-magnetic one-component blade coating development is employed, the triboelectric charging with a blade member or sleeve member may be utilized. In either case, the charge control agent need not necessarily be contained in the toner particles.

The polymerization initiator used in the present invention may include, e.g., azo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. The polymerization initiator may usually be used in an amount of from 0.5 to 20% by weight based on the weight of the polymerizable monomers, which varies depending on the intended degree of polymerization. The polymerization initiator may a little vary in type depending on the methods for polymerization, and may be used alone or in the form of a mixture, making reference to its 10-hour half-life period temperature.

In order to control the degree of polymerization, any known cross-linking agent, chain transfer agent and polymerization inhibitor may be further added.

When the suspension polymerization is used as the toner production process of the present invention, the dispersant used may include, e.g., as inorganic oxides, tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. As organic compounds, it may include polyvinyl alcohol, gelatin, methyl cellulose, methyl hydroxypropyl cellulose, ethyl cellulose, carboxymethyl cellulose sodium salt, and starch, which may be dispersed in an aqueous phase. Any of the dispersants may preferably be used in an amount of from 0.2 to 10.0 parts by weight based on 100 parts by weight of the polymerizable monomer.

As these dispersants, those commercially available may be used as they are. In order to obtain dispersed particles having a fine and uniform particle size, however, fine particles of the inorganic compound may be formed in the dispersion medium under high-speed agitation. For example, in the case of tricalcium phosphate, an aqueous sodium phosphate solution and an aqueous calcium chloride solution may be mixed under high-speed agitation to form fine particles of tricalcium phosphate, whereby a fine-particle dispersant preferable for the suspension polymerization can be obtained. In order to make the particles of these dispersants fine, 0.001 to 0.1 part by weight of a surface-active agent may be used in combination. Stated specifically, commercially available nonionic, anionic or cationic surface-active agents may be used. For example, those preferably used are sodium dodecylsulfate, sodium tetradecylsulfate, sodium pentadecylsulfate, sodium octylsulfate, sodium oleate, sodium laurate, potassium stearate and calcium oleate.

As a specific toner production process of the present invention, in the mixing step, the release agent comprising a low-softening substance, the colorant, the charge control agent, the polymerization initiator and other additives are added in the monomer and are uniformly dissolved or dispersed to prepare a monomer composition. In the next granulation step, the monomer composition is dispersed by a high shear force in a granulator holding a dispersion stabilizer dispersed in an aqueous medium. The granulation is stopped at the stage where the particles comprising the monomer composition have come to have the desired toner particle size. Thereafter, in the polymerization step, agitation may be carried out to such an extent that the state of particles is maintained and the particles are prevented from settling by the action of the dispersion stabilizer. The polymerization may be carried out at a polymerization temperature set at 40° C. or above, usually from 50 to 90° C. At the latter half of the polymerization, the temperature may be raised, and also the aqueous medium may be removed in part from the reaction system by carrying out the reduced pressure distillation at the latter half of the polymerization reaction or after the reaction has been completed, in order to remove unreacted polymerizable monomers, by-products and so forth. After the polymerization reaction has been completed, the toner particles formed are collected by washing and filtration, followed by drying. In the suspension polymerization, water may usually be used as the dispersion medium preferably in an amount of usually from 300 to 3,000 parts by weight based on 100 parts by weight of the monomer composition.

An external additive may be used in the present invention in order to impart various toner properties to the toner. It may preferably have a particle diameter not larger than 1/10 of a weight average particle diameter of the toner particles, in view of its durability when added to the toner. The particle diameter of this external additive refers to an average particle diameter determined by observing the toner particles on the electron microscope. As the external additive which may be used may include fine powders of metal oxides such as aluminum oxide, titanium oxide, strontium titanate, cerium oxide, magnesium oxide, chromium oxide, tin oxide and zinc oxide; nitrides such as silicon nitride; carbides such as silicon carbide; metal salts such as calcium sulfate, barium sulfate and calcium carbonate; fatty acid metal salts such as zinc stearate and calcium stearate; carbon black; and silica.

Any of these external additives may be used in an amount of from 0.01 to 10 parts by weight, and preferably from 0.05 to 5 parts by weight, based on 100 parts by weight of the toner particles, and may be used alone or may be used in combination in plurality. An external additive having been subjected to hydrophobic treatment is more preferred.

The average particle diameter and particle size distribution of the toner can be measured by various methods using a Coulter counter Model TA-II or Coulter Multisizer (manufactured by Coulter Electronics, Inc.). In the present invention, they are measured using the Coulter counter Model TA-II (manufactured by Coulter Electronics, Inc.). An interface (manufactured by Nikkaki K.K.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution are calculated by measuring the volume and number of toner particles with particle diameters of not smaller than 2 $\mu$m by means of the above Coulter counter Model TA-II, using an aperture of 100 $\mu$m as its aperture. Then the volume-based, weight average particle diameter (D4: the middle value of each channel is used as the representative value for each channel) is determined from the volume distribution.

EXAMPLES

The present invention will be described below in greater detail by giving a specific production process, Examples, and Comparative Examples. The present invention is by no means limited to these.

Example 1

In a granulation vessel provided with an inner wall made of stainless steel (SUS304) and having a jacket for temperature control, 15.0 parts by weight of ion-exchanged water, 14.4 parts by weight of an aqueous 0.1M-$Na_3PO_4$ solution were introduced, and the mixture was heated to 60° C., followed by stirring at 5,000 rpm using Clearmix (manufactured by M-Technique K.K.). Then, 2.18 parts by weight of an aqueous 1.0M-$CaCl_2$ solution was added thereto little by little to obtain an aqueous medium containing $Ca_3(PO_4)_2$. High-pressure saturated water vapor was fed into the jacket of this granulation vessel while adjusting the degree of vacuum in the jacket to about 25 kPa, and the liquid temperature was controlled at 60° C. while making control so that the inside of the jacket was filled with the saturated water vapor (water vapor having a lower absolute pressure than the atmospheric pressure).

| | (by weight) |
|---|---|
| Styrene (monomer) | 5.28 parts |
| n-Butyl acrylate (monomer) | 1.12 parts |
| C.I. Pigment Blue 15:3 (colorant) | 0.5 part |
| Salicylic acid metal compound (charge control agent) | 0.08 part |
| Saturated polyester (polar resin; acid value: 10 mg KOH/g; peak molecular weight: 7,500 Mn)) | 0.3 part |
| Ester wax (release agent; melting point: 70° C.) | 1.0 part |

Meanwhile, the above materials were put in a mixing vessel whose inner wall was coated with fluorine resin and having a jacket for temperature control. The contents were then heated to 60° C. and uniformly dissolved and dispersed. In the resultant mixture, 0.3 part by weight of a polymerization initiator 2,2'-azobis(2,4-dimethylvaleronitrile) was dissolved. Thus, a polymerizable monomer composition was prepared. High-pressure saturated water vapor was fed into the jacket of this mixing vessel while adjusting the degree of vacuum in the jacket to about 25 kPa, and the liquid temperature was controlled at 60° C. while making control so that the inside of the jacket was filled with the saturated water vapor (water vapor having a lower absolute pressure than the atmospheric pressure).

The contents (polymerizable monomer composition) in the mixing vessel obtained was introduced into the granulation vessel holding the aqueous medium prepared as described above, and the contents in the granulation vessel were stirred at 5,000 rpm (blade tip peripheral speed: 24.9 m/s; d/D: 0.27), at 60° C. in an atmosphere of nitrogen ($N_2$) by means of an agitator to carry out granulation of the polymerizable monomer composition. Then, at the stage where particles of about 7 $\mu$m diameter were mainly formed (granulation time: 6 minutes), the granulation was stopped.

The polymerizable monomer composition having been thus granulated was transferred to a polymerization vessel whose inner wall was provided with glass lining and having a jacket for temperature control. High-pressure saturated water vapor was fed into the jacket of this polymerization vessel while adjusting the degree of vacuum in the jacket to about 25 kPa, and the liquid temperature was controlled at 60° C. while making control so that the inside of the jacket was filled with the saturated water vapor (water vapor having a lower absolute pressure than the atmospheric pressure). Then, with stirring by means of paddle agitating blades in an atmosphere of nitrogen ($N_2$), the polymerization reaction was carried out for 5 hours. Thereafter, high-pressure saturated water vapor was further fed into the jacket of the polymerization vessel while adjusting the degree of vacuum in the jacket to about 60 kPa, and the liquid temperature was controlled at 80° C. while making control so that the inside of the jacket was filled with the saturated water vapor (water vapor having a lower absolute pressure than the atmospheric pressure). Then, with stirring by means of paddle agitating blades in an atmosphere of nitrogen ($N_2$), the polymerization reaction was further carried out for 3 hours.

After the polymerization reaction was completed, the residual monomers were distilled off under reduced pressure, the reaction product was cooled, and thereafter hydrochloric acid was added to dissolve the calcium phosphate, followed by filtration, washing with water and drying to obtain colored suspension polymerization particles. The colored suspension polymerization particles were set on Coulter Multisizer to measure particle size distribution to reveal that the particles had a weight average particle diameter of about 6.7 $\mu$m and contained 17.0% by number of particles with diameters of 4 $\mu$m or smaller and 3.0% by volume of particles with diameters of 10.1 $\mu$m or larger, showing a very sharp particle size distribution. Cross sections of the particles were also observed to have confirmed their core/shell structure.

To 100 parts of the particles thus obtained, hydrophobic fine silica powder having a specific surface area of 200 $m^2/g$ as measured by the BET method was externally added to obtain a suspension polymerization toner. To 5 parts by weight of this toner, 95 parts by weight of a ferrite carrier coated with acrylic resin was blended to obtain a developer. Using this developer and using a modified machine of a full-color copying machine CLC500, manufactured by CANON INC., images were continuously reproduced on 5,000 sheets to make evaluation. As a result, no offset occurred, and good images free of fog and with a stable image density were formed.

In the polymerization step, evaluation was also made on the quantity of deposits inside the polymerization vessel, the time for temperature rise when temperature was raised from 60° C. to 80° C. and the temperature stability. Results of the evaluation are shown in Table 1.

Evaluation criteria are as follows:

Deposits inside the polymerization vessel

A: 10 g or less

B: 11 to 20 g

C: 21 to 50 g

D: 51 g or more

Temperature rise time

Time (minutes) taken when the temperature was raised from 60° C. to 80° C.

Temperature stability

Fluctuation of temperature during polymerization reaction carried out while keeping the temperature constant, in the polymerization step.

Comparative Examples 1 and 2

Developers were prepared in the same manner as in Example 1 except that the water vapor having a lower absolute pressure than the atmospheric pressure, used as a means for heating the contents and keeping the temperature constant, was replaced with high-pressure saturated water vapor having an absolute pressure of 200 kPa, or hot water. Here, the hot-water temperature in the instance where hot water was used was set at a temperature higher by 5 ° C. than the control temperature for the contents.

In the polymerization step, the evaluation on the quantity of deposits inside the polymerization vessel, the time for temperature rise when temperature was raised from 60° C. to 80° C. and the temperature stability was also made in the same manner as in Example 1. Results obtained are shown in Table 1.

TABLE 1

| | Heat source in jacket | Deposits inside polymerization vessel | Temperature rise time | Temperature stability |
|---|---|---|---|---|
| Example: | | | | |
| 1 | Water vapor lower in absolute pressure than the atmospheric pressure | A | 50 min. | ±0.5° C. |
| Comparative Example: | | | | |
| 1 | High-pressure vapor | C | 40 min. | ±2.0° C. |
| 2 | Hot water | A | 90 min. | ±0.5° C. |

As can be seen from Table 1, when the water vapor having a lower absolute pressure than the atmospheric pressure is used as a means for heating the contents and keeping the temperature constant, no deposits occur in the vessel. Also, a superior temperature response can be achieved and the temperature can be raised in a shorter time, so that the production cost can be made lower. On the other hand, when high-pressure vapor is used, deposits in the vessel occur in a large quantity and also no good temperature stability can be achieved. When hot water is used, a good result is seen in respect of the deposits inside the vessel, but it takes a long time to raise temperature, showing an inferior temperature response. Moreover, much plant investment is required for hot-water tanks and so forth, also causing a great heat loss. Thus, the use of hot water is inferior to the use of the water vapor having a lower absolute pressure than the atmospheric pressure in respect of the production costs.

Example 2

Developers were prepared in the same manner as in Example 1 except that the materials and aqueous medium used therein for producing the toner particles were used in 8-fold quantities.

Comparative Example 3

A developer was prepared in the same manner as in Example 2 except that the water vapor having a lower absolute pressure than the atmospheric pressure, used as a means for heating the contents and keeping the temperature constant, was replaced with hot water. Here, the hot-water temperature was set at a temperature higher by 5° C. than the control temperature for the contents.

When hot water is used as a means for heating the contents and keeping the temperature constant, a much larger hot-water tank becomes necessary with an increase in production quantity to cause an increase in investment cost, and also heat loss increases, resulting in a great increase in production cost. On the other hand, when the water vapor having a lower absolute pressure than the atmospheric pressure is used, the production cost can be prevented from increasing even with an increase in production quantity.

What is claimed is:

1. A process for producing a toner for developing electrostatic images; the toner comprising toner particles, and the process comprising;

a mixing step of preparing a polymerizable monomer composition containing at least a polymerizable monomer and a colorant;

a granulation step of dispersing the polymerizable monomer composition in an aqueous medium by the action of a high shear force to produce particles of the polymerizable monomer composition; and a polymerization step of polymerizing the polymerizable monomer held in the particles of the polymerizable monomer composition, to form the toner particles;

wherein said polymerization step is carried out in a container having a jacket, and the liquid temperature inside the container is controlled by feeding a high-pressure vapor into the jacket while adjusting the degree of vacuum inside the jacket.

2. The process according to claim 1, wherein said mixing step is carried out in a container having a jacket, and the liquid temperature inside the container is controlled by feeding a high-pressure vapor into the jacket while adjusting the degree of vacuum inside the jacket.

3. The process according to claim 1, wherein said granulation step is carried out in a container having a jacket, and the liquid temperature inside the container is controlled by feeding a high-pressure vapor into the jacket while adjusting the degree of vacuum inside the jacket.

4. The process according to claim 1, wherein said mixing step and said granulation step are each carried out in a container having a jacket, and the liquid temperature inside the container is controlled by feeding a high-pressure vapor into the jacket while adjusting the degree of vacuum inside the jacket.

5. The process according to claim 1, wherein said polymerizable monomer composition contains a styrene monomer.

6. The process according to claim 1, wherein said polymerizable monomer composition contains a polar resin.

7. The process according to claim 1, wherein said polymerizable monomer composition contains a low-softening substance having an endothermic maximum peak in a temperature range of from 40° C. to 90° C. as measured by differential scanning calorimetry.

8. The process according to claim 1, wherein said polymerizable monomer composition contains a polymerization initiator.

9. The process according to claim 1, wherein the degree of vacuum inside the jacket is adjusted to from 10 kPa to 90 kPa.

10. The process according to claim 2, wherein the degree of vacuum inside the jacket is adjusted to from 10 kPa to 90 kPa.

11. The process according to claim 3, wherein the degree of vacuum inside the jacket is adjusted to from 10 kPa to 90 kPa.

12. The process according to claim 4, wherein the degree of vacuum inside the jacket is adjusted to from 10 kPa to 90 kPa.

13. The process according to claim 1, wherein the degree of vacuum inside the jacket is adjusted to from 10 kPa to 80 kPa.

14. The process according to claim 2, wherein the degree of vacuum inside the jacket is adjusted to from 10 kPa to 80 kPa.

15. The process according to claim 3, wherein the degree of vacuum inside the jacket is adjusted to from 10 kPa to 80 kPa.

16. The process according to claim 4, wherein the degree of vacuum inside the jacket is adjusted to from 10 kPa to 80 kPa.

17. The process according to claim 1, wherein the container used in said polymerization step is provided with glass lining on its inner wall.

18. The process according to claim 1, wherein said toner particles have a core/shell structure.

19. The process according to claim 14, wherein the core is chiefly composed of a low-softening substance.

20. The process according to claim 1, wherein the high-pressure vapor fed into the jacket is a saturated water vapor.

21. The process according to claim 2, wherein the high-pressure vapor fed into the jacket is a saturated water vapor.

22. The process according to claim 3, wherein the high-pressure vapor fed into the jacket is a saturated water vapor.

23. The process according to claim 4, wherein the high-pressure vapor fed into the jacket is a saturated water vapor.

24. The process according to claim 1, wherein the temperature inside the jacket is controlled to from 45° C. to 95° C.

25. The process according to claim 2, wherein the temperature inside the jacket is controlled to from 45° C. to 95° C.

26. The process according to claim 3, wherein the temperature inside the jacket is controlled to from 45° C. to 95° C.

27. The process according to claim 4, wherein the temperature inside the jacket is controlled to from 45° C. to 95° C.

28. The process according to claim 1, wherein the inside of the jacket is filled with a saturated water vapor.

29. The process according to claim 2, wherein the inside of the jacket is filled with a saturated water vapor.

30. The process according to claim 3, wherein the inside of the jacket is filled with a saturated water vapor.

31. The process according to claim 4, wherein the inside of the jacket is filled with a saturated water vapor.

32. The process according to claim 1, wherein the degree of vacuum inside the jacket is adjusted to from 10 kPa to 80 kPa and the inside of the jacket is filled with a saturated water vapor.

33. The process according to claim 1, wherein said polymerization step is carried out at a temperature of from 50° C. to 90° C.

* * * * *

UNITED STATES PATENT AND TRADEMARK OFFICE

CERTIFICATE OF CORRECTION

PATENT NO. : 5,916,726

DATED : June 29, 1999

INVENTOR(S) : HITOSHI KANDA, ET AL.

It is certified that error appears in the above-identified patent and that said Letters Patent is hereby corrected as shown below:

COLUMN 1

Line 48, "come" should read --become separated--; and
Line 49, "bare" should be deleted.

COLUMN 2

Line 4, "come bare" should read --become separated--; and
Line 63, "comprising;" should read --comprising:--.

COLUMN 4

Line 14, "It has such a problem." should be deleted; and
Line 24, "low" should read --lower--.

COLUMN 5

Line 2, "comes into a great question" should read --causes a large problem--.

COLUMN 6

Line 6, "revolution" should read --revolutions--;
Line 28, "coalesce" should read --coalesce with--; and
Line 30, "revolution" should read --revolutions--.

UNITED STATES PATENT AND TRADEMARK OFFICE

CERTIFICATE OF CORRECTION

PATENT NO. : 5,916,726

DATED : June 29, 1999

INVENTOR(S) : HITOSHI KANDA, ET AL.

It is certified that error appears in the above-identified patent and that said Letters Patent is hereby corrected as shown below:

COLUMN 7

Line 6, "prefer" should read --preferred--;
Line 7, "red to t he" should read --to the--; and
Line 50, "coalesce" should read --coalesce with--.

COLUMN 9

Line 31, "an an" should read --an--; and
Line 55, "a" should read --an--.

COLUMN 14

Line 67, "comprising;" should read --comprising:--.

Signed and Sealed this

Fourteenth Day of December, 1999

*Attest:*

Q. TODD DICKINSON

*Attesting Officer*

*Acting Commissioner of Patents and Trademarks*